US006050842A

United States Patent [19]

Ferrill et al.

[11] Patent Number: 6,050,842

[45] **Date of Patent: *Apr. 18, 2000**

[54] ELECTRICAL CONNECTOR WITH PAIRED TERMINALS

[75] Inventors: Jess Britton Ferrill, Madison; Terry Lee Pitts, Greensboro, both of N.C.

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/723,230

[22] Filed: Sep. 27, 1996

[51] Int. Cl.[7] ..... H01R 4/24

[52] U.S. Cl. ..... 439/404; 439/941

[58] Field of Search ..... 439/404, 405, 439/941

[56] References Cited

U.S. PATENT DOCUMENTS

| | | | |
|---|---|---|---|
| 3,496,522 | 2/1970 | Ellis, Jr. et al. | 439/404 |
| 3,702,456 | 11/1972 | Patton | 339/198 H |
| 3,820,058 | 6/1974 | Friend | 339/99 R |
| 3,877,771 | 4/1975 | Jensen et al. | 339/19 |
| 3,899,237 | 8/1975 | Briggs, Jr. | 339/99 |
| 4,013,332 | 3/1977 | Dauser, Jr. | 339/98 |
| 4,066,317 | 1/1978 | Bierenfeld et al. | 339/91 R |
| 4,171,857 | 10/1979 | Forberg et al. | 339/97 P |
| 4,452,502 | 6/1984 | Forberg et al. | 339/99 R |
| 4,533,196 | 8/1985 | Forberg et al. | 439/404 |
| 4,618,201 | 10/1986 | Townsend | 339/99 R |
| 4,778,407 | 10/1988 | Myers | 439/443 |
| 5,282,754 | 2/1994 | Kish et al. | 439/108 |
| 5,362,257 | 11/1994 | Neal et al. | 439/676 |
| 5,409,404 | 4/1995 | Reed | 439/736 |
| 5,494,461 | 2/1996 | Bippus et al. | 439/709 |
| 5,554,053 | 9/1996 | Matthews | 439/719 |
| 5,556,296 | 9/1996 | Dussausse et al. | 439/941 |
| 5,605,469 | 2/1997 | Wellinsky et al. | 439/417 |

FOREIGN PATENT DOCUMENTS

| | | | |
|---|---|---|---|
| 0 590 796 A2 | 4/1994 | European Pat. Off. | H01R 23/02 |
| 0 598 192 A1 | 5/1994 | European Pat. Off. | H01R 23/02 |
| 002263022 | 7/1993 | United Kingdom | 439/404 |

OTHER PUBLICATIONS

AMP Standard Products Catalog 2012–2, Issued Mar. 1985, pp. 620–621: "AMP–Latch Connectors" and Non–Polarized Receptacles, .100×.100 [2.54×2.54] Centers.

*Primary Examiner*—Paula Bradley
*Assistant Examiner*—Tho D. Ta
*Attorney, Agent, or Firm*—Robert Kapalka

[57] ABSTRACT

Electrical connector 10 is used to terminate individual wires 6, 8 in two twisted wire pairs 2, 4. The connector includes an insulated housing with terminals 50 located in terminal receiving cavities 34 in the housing. The terminals 50 are inclined relative to parallel wire receiving channels 34 and paired terminals 50 for terminating individual wires of a the same twisted wire pair, 2 or 4 are spaced closer together than adjacent intermediate terminals associated with different wire pairs. Pairing inclined terminals 50 increases the coupling between wires in the same wire pair and increasing the spacing between terminals of different wire pairs reduces the capacitive cross talk between adjacent wire pairs. High frequency performance of the electrical connector 10 is thereby increased. A central cavity between terminal pairs increases the effective dielectric constant to further reduce crosstalk. Inclining the terminals 50 also allows the relative width of the terminals to be increased so that the strength of the housing 12 can be increased and the retention of the terminals 50 in the housing 12 can be improved.

15 Claims, 6 Drawing Sheets

ELECTRICAL CONNECTOR WITH PAIRED TERMINALS

BACKGROUND OF THE INVENTION

1. Field of the Invention

This invention is related to an electrical connector that is used to terminate twisted pair wires. This invention is also related to electrical connectors that employ slotted beam or insulation displacement contacts or terminals to establish an electrical connector with insulated wires. More particularly, this invention is also related to electrical connectors that can be used to improve inductive and capacitive electrical coupling between individual wires in a twisted pair and to reduce crosstalk between adjacent twisted pairs for higher frequency transmission, such as 100 Mhz signals.

2. Description of the Prior Art

A conventional 110 style electrical connector used to terminate twisted pair telecommunications cables is shown in FIG. 1. These connectors 110 employ slotted beam or insulation displacement contact terminals 150. The connector shown in FIG. 1 is a four position connector that is used to terminate tip and ring wires in a two pair cable to a printed circuit board using compliant pin sections 156. The four terminals 150 are positioned side by side with the planar slotted beam portions 152 of the four terminals located in the same plane. Terminals 150 are received in cavities 136 in an insulated housing 112 that extend into tapered divider walls 124, center walls 120 and side walls 122 located on the top of the housing 112. These walls 120, 122, 124 define channels into which wires are inserted. Wires inserted laterally of their axes into these channels are inserted into the wire contact slots 174 in the slotted beams 152 of the terminals 150. The edges of the slotted beam defining the wire contact slots penetrate the wire insulation and establish a gas tight electrical connection to the wire. Terminals 150 are held in the housing 112 by tabs 162 struck from the sides of the terminal and by plastic inserted into the terminal opening left when the tabs 162 are formed. An electrical connector of similar construction that is used for splicing separate twisted pair cables is disclosed in U.S. Pat. No. 5,409,404, Another connector that uses slotted beams or insulation displacement contacts with twisted pair cables is shown in U.S. Pat. No. 4,171,857. In that patent the terminals are fixedly disposed at an angle offset by about forty-five degrees with respect to a wire slot in a housing clamping element. That prior art connector is used to connect two wires to opposite bifurcated sections of the same terminal. The edges of the terminal element are offset at an angle so that the edges of the wire slot penetrate through the insulation of a wire and connect to the wire conductor.

Each of these prior art connectors is primarily intended for use with conventional twisted pair cable of the type commonly used for telephone communications. Recently twisted pair cable has been increasingly used for higher speed or higher frequency applications such as networked data communications. Standard twisted pair cable is not suitable for many of these applications because the transmission characteristics of standard twisted pair cable and twisted pair connectors are not satisfactory for these higher frequency applications. Therefore new standards for twisted pair cable suitable for higher frequencies have emerged. Category 5 twisted pair cable is one such cable. These cables are more tightly twisted to increase inductive and capacitive electrical coupling between individual wires forming each twisted pair. More stringent restrictions on crosstalk, and especially near end crosstalk (NEXT), have also been placed on these higher performance twisted pair cables. In many instances standard electrical connectors developed for use in the telephone industry can degrade the performance of twisted pair cable installations intended for use in higher frequency applications. These standard electrical connectors are however widely used and common footprints and installation tooling are widely known in the industry. There is therefore a desire to retain the well understood characteristics of these standard electrical connectors, but at the same time improve their performance.

SUMMARY OF THE INVENTION

The instant invention is directed to an electrical connector configuration that addresses the shortcomings of standard electrical connectors, such as 110 style electrical connectors, when used with twisted pair cable intended for higher frequency applications.

An object of this invention is therefore to improve the coupling between individual wires of the same twisted pair at the electrical connector by maintaining the tighter twist of higher performance twisted pair cables closer to the connector.

This invention is also intended to reduce the crosstalk between adjacent twisted pairs at the connector by reducing the capacitance between adjacent terminals connected to adjacent wire pairs.

These objects are also achieved in a manner that is consistent with standard practices for conventional electrical connectors. For example, this invention can be implemented in an electrical connector having the same cross sectional area as a standard 110 style connector and having the same contact footprint. Standard wire insertion tools used for 110 style connectors can also be used with a connector embodying this invention.

Another object of this invention is to simplify the manner in which an electrical connector using compliant pins can be mounted on a printed circuit board.

These improvements need to be achieved in a manner that will not compromise the structural integrity of either the molded housing or the terminals used in connectors of this type. Indeed, improvements in the strength and reliability of the housing and of the manner in which the terminals are retained in the housing should also result from the use of this invention.

These and other objectives are met by employing a configuration in which the terminals in a connector are inclined and offset relative to wire channels in a housing. Paired terminals used for each wire pair can be moved closer together into an overlapping relationship and separate terminal pairs can be separated to improve crosstalk performance The terminals can also be made wider to improve terminal retention in the housing.

These and other advantages are achieved in an electrical connector comprising an insulating housing and slotted beam terminals for terminating individual wires in twisted wire pairs. The housing includes wire channels and intersecting terminal cavities. The terminals are positioned in the terminal cavities with a wire contact slot aligned with the corresponding wire channel. In the preferred embodiment the maximum width of the terminals is greater than the centerline spacing between adjacent wire channels that receive individual wires of the same wire pair. The terminals and the terminal cavities are inclined relative to the wire channels to achieve such spacing.

By pairing terminals associated with wires in the same wire pair, the coupling between the wires can be improved at the connector to improve the high frequency performance of the connector and the twisted wire pair. By pairing the terminals to be used with the same wire pair, terminals for different wire pairs can be separated to reduce crosstalk between adjacent wire pairs By inclining the terminals relative to the wire channels, additional space is available to make the terminals wider than for conventional terminals of the same type and to make housing walls in the connector thicker than for conventional connectors with the terminals positioned side by side in the same plane. Terminal retention in the housing can therefore be improved. Improved terminal retention is especially important for connectors using compliant pins that must be inserted into plated through holes in a printed circuit board. Increased housing wall thickness limits breakage and damage to the connector.

DETAILED DESCRIPTION OF THE PREFERRED EMBODIMENTS

Figure 2:
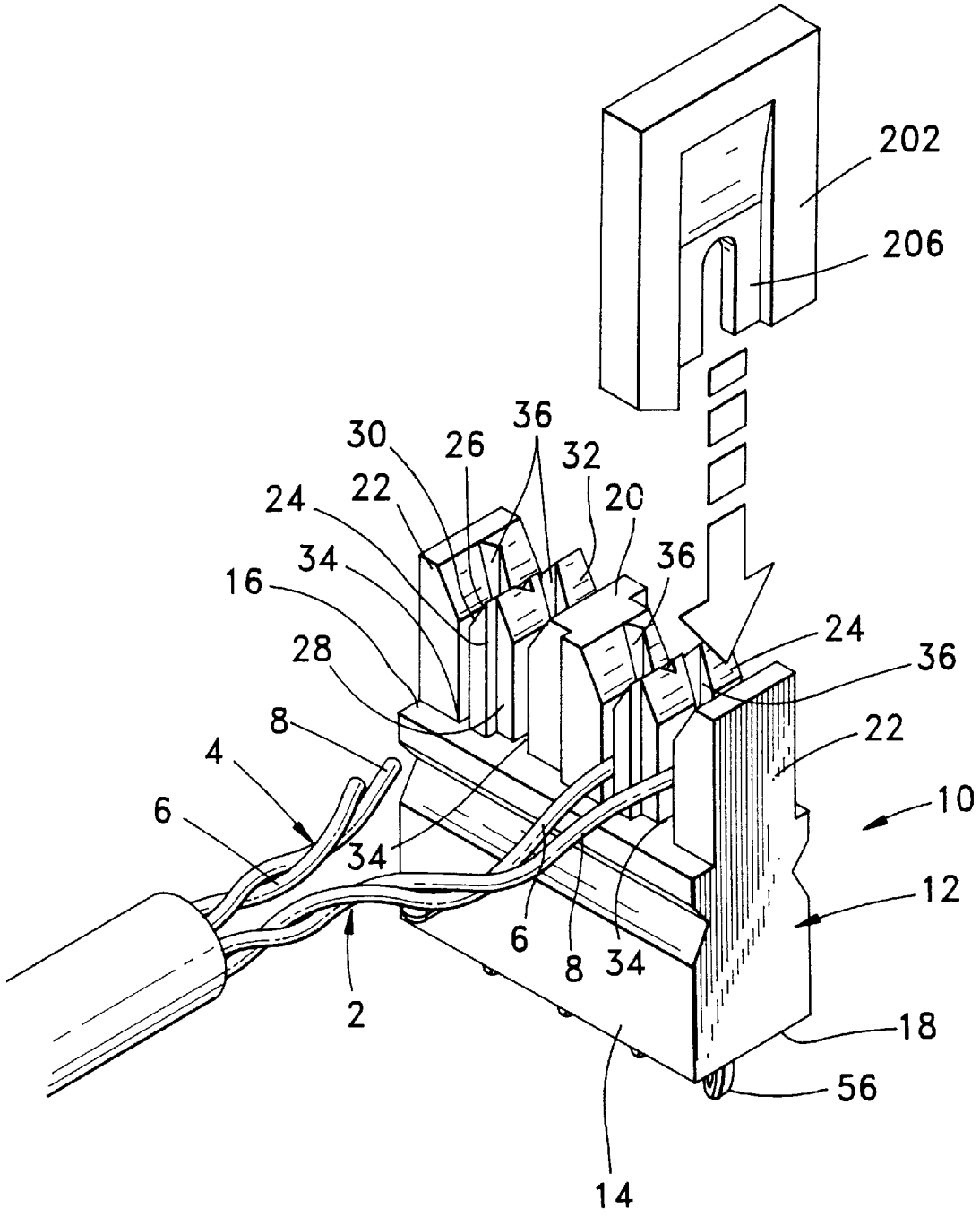
FIG. 2 is a perspective view of the preferred embodiment of an electrical connector employing paired terminals and showing the insertion of individual wires of first and second twisted wire pairs in a wire cable.

The preferred embodiment of this invention is shown in FIG. 2. Electrical connector 10 is a 110 style electrical connector that is used to connect a first twisted wire pair 2 and a second twisted wire pair 4 to a printed circuit board (not shown). Each twisted pair 2, 4 includes two wires 6 and 8 that are typically used in a balanced pair transmission line. Electrical connector 10 can be employed with conventional twisted pair cable of the type commonly used for conventional telecommunications. This connector 10 can also be used for higher speed applications since connector 10 is intended to improve the coupling between wires in the same twisted pair relative to conventional 110 style connectors and to reduce crosstalk between adjacent twisted pairs relative to conventional 110 style connectors. Specifically this connector 110 is intended to be used with higher performance twisted pair cable configurations, such as Category 5 twisted pair cables, that employ a tighter twist than conventional twisted pair cables.

Figure 5:
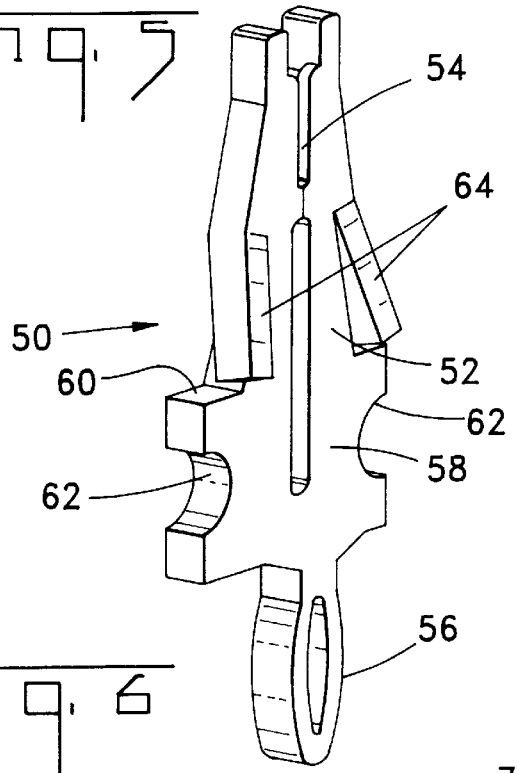
FIG. 5 is a perspective view of one embodiment of a terminal that could be used in the electrical connector of the type shown in FIGS. 2–4.
Figure 8:
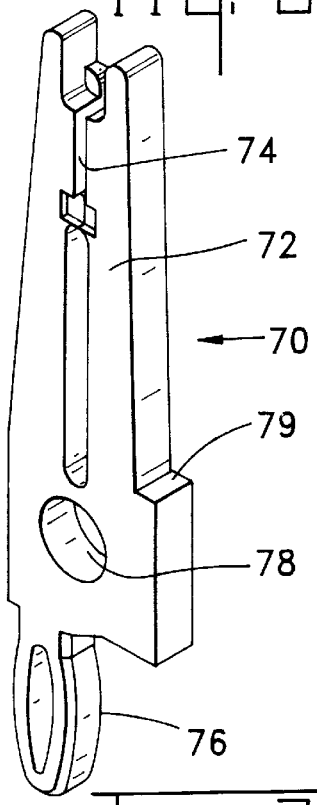
FIG. 8 is a perspective view showing an alternate embodiment of a terminal that could be used in and electrical connector of the type shown in FIGS. 2–4.
Figure 6:
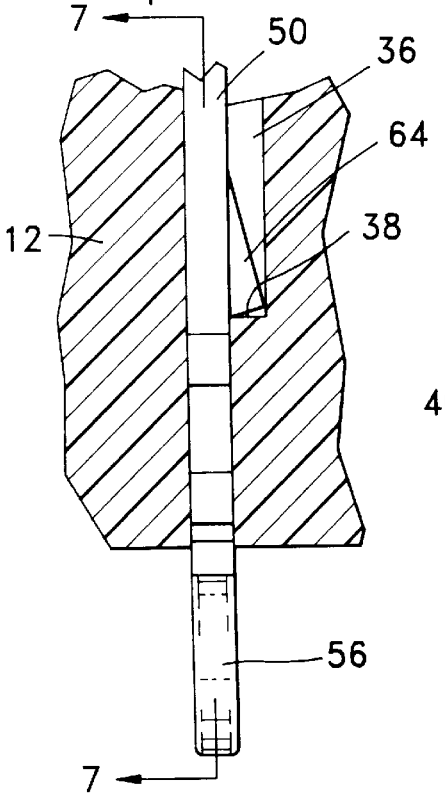
FIG. 6 is a partial section view showing the manner in which the terminal shown in FIG. 5 is secured to prevent the terminal from being pushed through the bottom of the connector housing.
Figure 7:
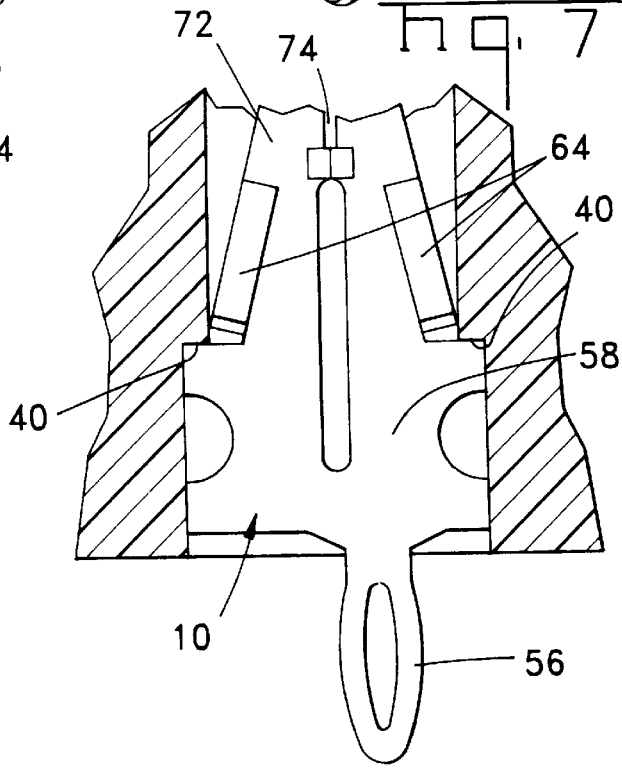
FIG. 7 is a partial section view showing the manner in which the terminal shown in FIG. 5 is secured to prevent the terminal from being pushed out the top of the connector housing.

The connector 10 is a four position connector in which four slotted beam or insulation displacement terminals 50, as shown in FIGS. 5–7, or alternate terminals 70, as shown in FIG. 8, are inserted into a molded insulated housing 12. Housing 12 is a one piece structure having a base portion 14 with walls extending upwardly from an upper base surface 16. In the four position embodiment, one central wall 20 and two side walls 22 are separated by two tapered divider walls 24. As shown in FIG. 2, the tapered divider walls 24 are configured to act as splitters or dividers over which the individual wires 6, 8 forming one of the twisted wire pairs are separated. The wires 6, 8 enter wire channels 34 formed on either side of one of the tapered divider walls 24. The channels 34 are also formed by an adjacent central wall 20 or an adjacent side wall 22.

Figure 1:
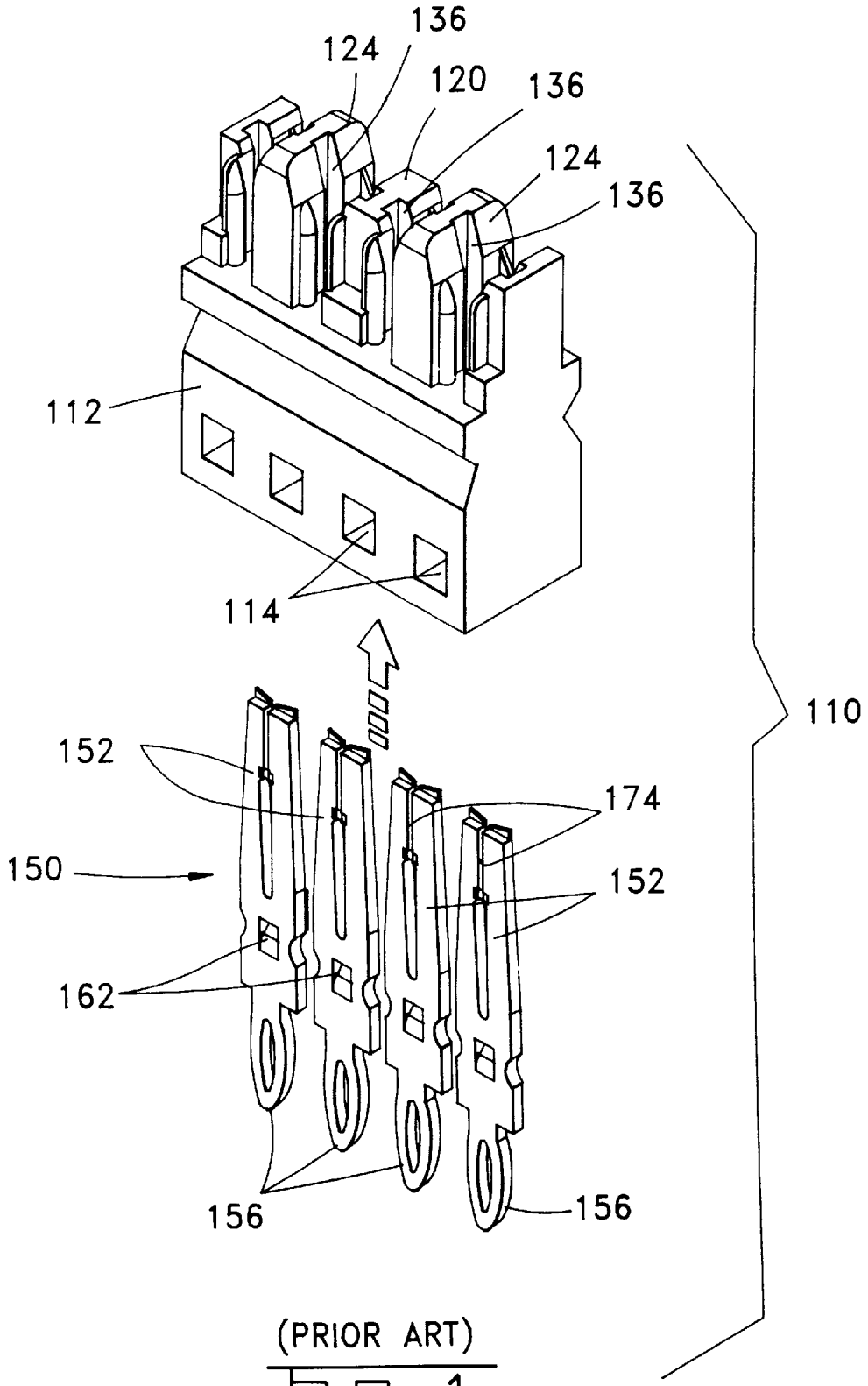
(PRIOR ART) Fig. 1
FIG. 1 is a perspective view of a prior art electrical connector used with twisted wire pairs showing the terminals exploded from the insulated housing of the electrical connector.

Each tapered divider wall 24 differs from the divider wall 124 in a conventional 110 style connector such as that shown in FIG. 1. Each tapered divider wall 24 includes two mutually staggered sections 26, 28 that are respectively offset toward the front and rear or the housing 12 as viewed in FIG. 2. Each staggered section has an inclined upper surface 30 and 32 respectively. The front inclined surface 30 merges with the rear inclined surface 32 along a straight line apex at the top of the tapered divider wall. Although each tapered divider wall 24 is described as having two sections 26, 28, it should be understood that each tapered divider wall is an integrally molded portion of the housing 12 and the staggered sections 26, 28 are really part of the same one-piece structure. These staggered sections permit the use of a standard, commonly available, single position insertion tool commonly employed to terminate conventional 110 style connecting blocks such as that shown in FIG. 1.

Figure 3:
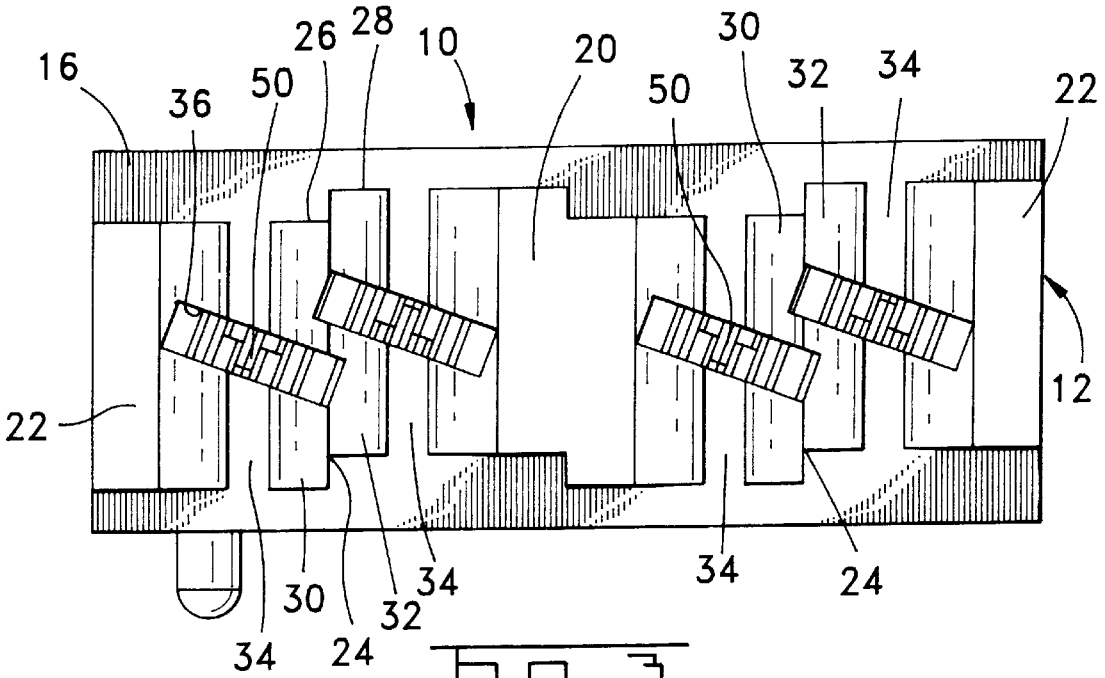
FIG. 3 is a top plan view of the electrical connector shown in FIG. 2.
Figure 4:
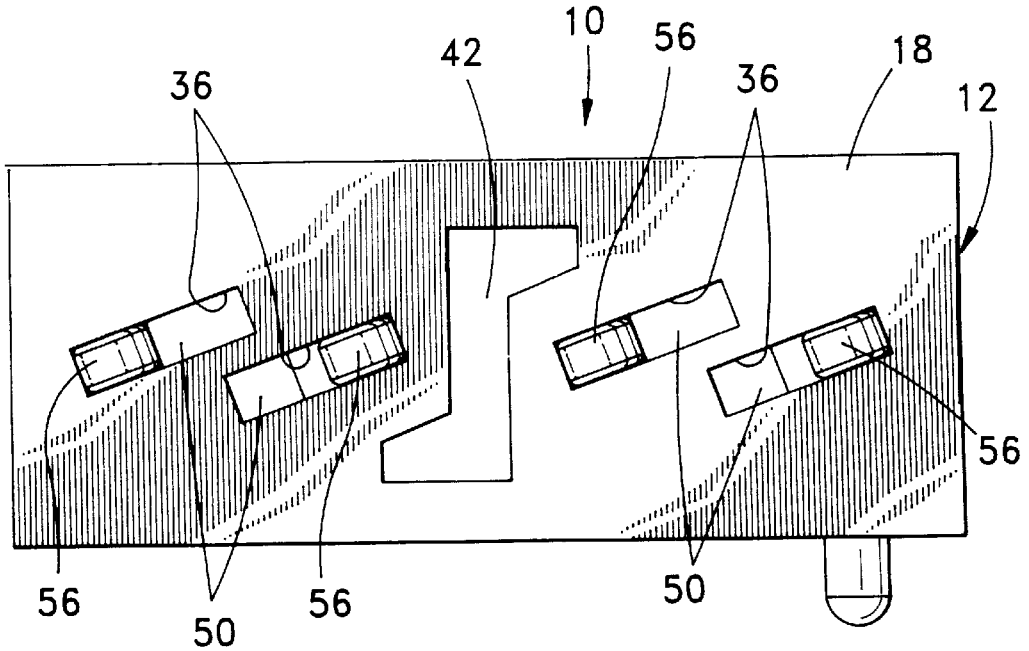
FIG. 4 is a bottom view of the electrical connector shown in FIGS. 2 and 3.

The wire channels 34 extend from the apex at the top of the tapered divider walls 24 to the upper surface 16 of the housing base 14. The four wire channels 34 are mutually parallel and are perpendicular to the front and rear faces of the housing 12 between which the channels 34 extend Terminal cavities 36 extend from the lower surface 18 of the housing base 14 through the upper surface 16 of the housing base 14 and extend upwardly in the tapered divider walls 24, the central wall 20 and the side walls 22 where they are manifested as opposed grooves extending into the corresponding wall from a corresponding wire channel 34. As shown in FIG. 3 and 4, the terminal cavities 36 are inclined relative to the wire channels 34. Preferably the angle of inclination is between fifteen and thirty degrees. An inclination of twenty degrees is shown in the embodiment depicted herein.

A central cavity 42 extends upwardly from the lower surface 18 of the housing base 14 as shown in FIG. 4. This central cavity 42 is cored during molding of the housing 12 and extends upwardly into the central wall 20. In the preferred embodiment, the central cavity 42 terminates below the top surface of the central wall 20, which has a continuous upper surface as shown in FIGS. 2 and 3.

One terminal 50 that can be used in connector 10 is shown in FIGS. 5–7. This terminal 50 is stamped and formed from a flat metal strip of a resilient metal. Terminal 50 has a flat or planar slotted beam or insulation displacement contact section 52. A wire contact slot 54 is formed between two opposed contact beams. A wire inserted laterally of its axis into the contact slot 54 will be engaged by the inward facing edges of the wire contact slot 54 and a gas tight mechanical and electrical connection will be established between the wire and the terminal 50.

Terminal 50 also includes a compliant pin 56 that can be inserted into a plated through hole in a printed circuit board. A press fit mechanical and electrical connection can then be established between the compliant pin 56 and the plated through hole. Insertion of the pin 56 into the hole will cause deflection of the two opposed arms forming the compliant pin 56 to establish a contact force between the pin and the plated through hole. As with other contacts having a compliant pin section of the type depicted herein, significant, though not excessive, force will be required to insert the pin into the plated though hole. In the embodiment of FIG. 5, the compliant pin 56 is offset relative to the centerline of the terminal running through the central wire contact slot 54. This offset can be seen more clearly in FIG. 7 and in FIG. 4.

The slotted beam 52 and the compliant pin 56 extend from opposite sides of a central terminal section 58. Terminals 50 are preferably stamped in a progressive die and the center section 58 would form a part of the carrier strip interconnecting adjacent terminals when in strip form. When adjacent terminals are severed from the carrier strip to form individual terminals 50 a portion of that carrier strip forms central section 58 and upwardly facing shoulders 60 are formed on opposite edges of the central section 58. As can be seen in FIG. 5 semicircular recesses 52 are formed on opposite edges of the central section 58 beneath the shoulders 60. These semicircular recesses 52 are left by the pilot holes in the carrier strip after the individual terminals 50 are separated.

Along the outer edges of the slotted beam portion 52 of terminals 50, spring fingers 64 are formed. These spring fingers 64 are cantilever beams that are joined to the slotted beam sections 52 at their upper ends. The free ends of the cantilever beam spring fingers 64 face downwardly when viewed from the perspective of FIG. 5. The spring fingers 64 are formed to extend out of the plane of the slotted beam section 52 when at rest, but the spring fingers 64 can be deflected into the plane of the rest of the terminal when the terminal is inserted into a terminal cavity 36 in housing 12.

Contact terminals 50 are inserted into the terminal cavities 36 of housing 12 from below. The manner in which these terminals 50 are retained in the housing 12 is shown in FIGS. 6 and 7. Each terminal cavity 36 includes an upwardly facing shoulder 38 located along one longer side of the generally rectangular terminal cavity 36. The width of the terminal cavity 36 is smaller below this upwardly facing shoulder 38 than that portion of the cavity extending from the shoulder 38 to the upper surface 16 of the housing base 14. The width of the portion of the terminal cavity below shoulder 38 is substantially equal to the thickness of the terminal 50. As the terminal 50 is inserted upwardly through the portion of terminal cavity 36 below shoulder 38, the spring fingers 64 are deflected into the plane of the slotted beam 52. After the spring fingers 64 clear the shoulder 38, the spring fingers snap back to their normal position as shown in FIG. 6. The ends of the spring fingers then abut the upwardly facing shoulder 38 to prevent removal or downward movement of the terminal 50 so that the terminal 50 can not back out of the terminal cavity 36.

Each terminal cavity 36 also includes two downwardly facing shoulders 40 located on opposite ends of the rectangular shaped terminal cavity. Since the terminal shoulders 60 on the center terminal section 58 form the widest part of terminal 50, these terminal shoulders abut the downwardly facing housing cavity shoulders 40 to prevent further insertion of terminal 50 into terminal cavity 36. In this manner the terminals 50 cannot move in either direction when inserted to the position shown in FIGS. 6 and 7 and terminals 50 are held in position in the housing 12. An even more secure engagement can be achieved by deforming portions of the plastic housing base 14 into the semicircular recesses 62 in substantially the same manner as disclosed in U.S. Pat. No. 5,409,404.

An alternate terminal 70 that can be used in electrical connector 10 is shown in FIG. 8 This terminal 70 also has a slotted beam portion 72 and a wire contact slot 74. A compliant pin 76 extends from the bottom of terminal 70 and is offset relative to the centerline of the terminal along which the wire contact slot 74 extends. The central portion of the terminal 70 differs from the embodiment of FIGS. 5–7. A central hole 78 is located along the centerline of the terminal 70. This central hole 78 also serves as a pilot hole prior to the time when the terminal 70 is severed from its carrier strip. An upwardly facing shoulder 79 is formed along one edge of terminal 70 to abut a downwardly facing cavity shoulder of the same type as shoulder 40 in the housing configuration shown in FIG. 7 used with terminals 50 Retraction of terminal 70 from housing 12 can be prevented by upsetting a portion of the housing base 14 in line with hole 78 in much the same manner as shown in U.S. Pat. No. 5,409,404. The hole 78 can however be much larger than the opening formed by striking out a tab 162 in the conventional connector shown in FIG. 1. Better terminal retention can be achieved in this manner. An alternative way of retaining terminal 70 in the housing 12 would be to insert a pin through the side of the terminal housing base 14 and through the hole 78.

Figure 9:
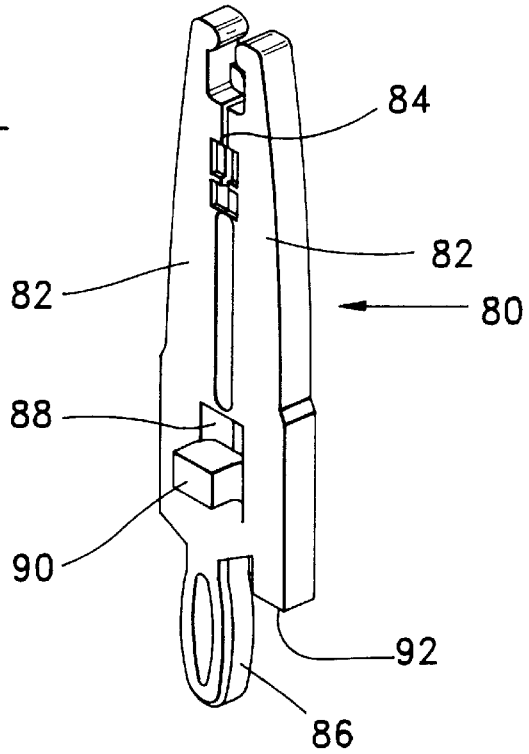
FIG. 9 is a perspective view of another alternate embodiment of the terminal.
Figure 10:
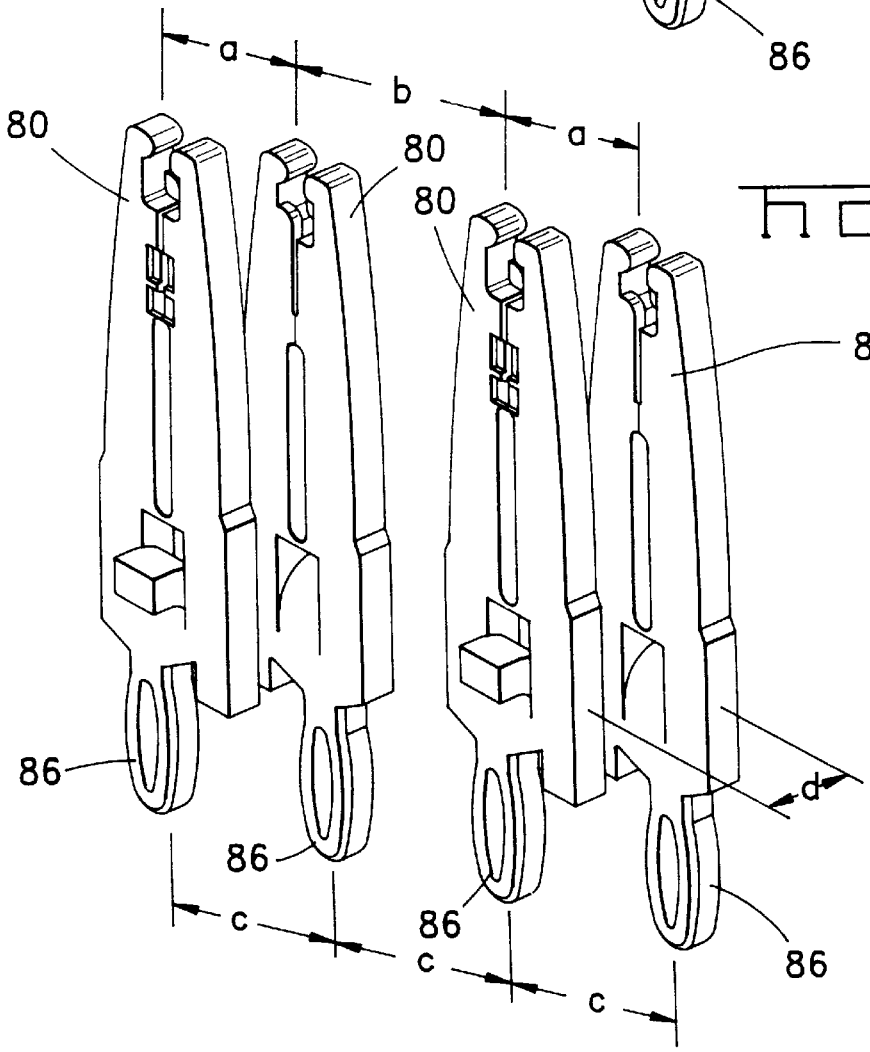
FIG. 10 is a perspective view showing four terminals of the type shown in FIG. 9 showing the relative angular orientation and spacing between these terminals.

Another version of a terminal 80 is shown in FIGS. 9 and 10. Terminal 80 is also an insulation displacement terminal having slotted beams 82 defining a wire contact slot 84 extending along the centerline of the slotted beam section of the terminal 80. Offset compliant beams 86 extend along the bottom of terminal 80. A central hole 88 is formed below the wire contact slot 84 and a tab 90 is struck out from the plane of the slotted beams 82. This tab 90 provides a retention surface for the terminal. Material can be upset or forced out of the housing into the terminal hole 88 to provide retention of the terminal in a corresponding housing Terminal 80 also includes a shoulder 92 that 5 would engage a printed circuit board and act as a stop to precisely position the connector and the terminals on a printed circuit board. Terminal 80 would be employed in substantially the same type housing as that shown in FIGS. 2–4. It should be understood however that the detail of the terminal cavities for receiving terminals 80 would differ from that shown in FIGS. 6 and 7. The relative positions that the terminals 80 would occupy in a connector 10 is shown in FIG. 10.

The spacing between the terminal centerlines of adjacent terminals 80 forming a single terminal pair for terminating a single wire pair is represented by a distance "a". The spacing between the second and third inner terminals 80, that are part of the separate first and second terminal pairs respectively is represented by a distance "b". For the preferred embodiments the distance "b" is greater than the distance "a" to reduce crosstalk between adjacent wire pairs. Because of the offset of compliant pins 86, the spacing between all adjacent compliant pins is constant and is represented by the distance "c". However, adjacent terminals 80 in the same terminal pair are offset or staggered by a distance "d".

Since the terminal cavities 36 are inclined relative to the wire channels 34, the terminals 50 will be angled relative to the wire channels 34. As shown in FIGS. 3 and 4, the terminals 50 will also be staggered and pairs of terminals 50 will overlap. By angling the terminals 50 and by overlapping two terminals 50 that are to be used to terminate the individual wires in the same twisted wire pair, the centerline of the terminals extending through the wire contact slots 54 can be spaced closer together. For the conventional connector shown in FIG. 1, all of the four terminals used with the four wires in two twisted pairs are evenly spaced on 0.150 inch centers. A closer spacing is not possible because the force and strength need for the slotted beam terminals to establish a suitable electrical connection with the wire dictates the minimum width of conventional terminals Molding and electrical isolation requirements in turn limit the closest spacing for terminal arranged in the same plane as in FIG. 1. By positioning the terminals in the angled configuration depicted for the preferred embodiment, the centerline spacing of the wire channels 34, the wire contact slots 54 and for the two wires of an individual wire pair 2 or 4 can be reduced In the preferred embodiment of this invention, the centerline spacing of two paired terminals on opposite sides of the same tapered divider wall 24 can be reduced to 0.100 inch or less for a terminal having substantially the same width as a terminal 150 used in the prior art configuration of FIG. 1 or the terminals can be wider for increased overlap and a greater normal contact force. Bringing the centerlines closer together improves the coupling of the individual wires of the same twisted wire pair relative to that which can be achieved with a conventional side by side coplanar configuration. For higher frequency applications, this paired terminal configuration yields relative coupling improvement that is more important than for conventional applications.

For twisted pair cables, such as Category 5 twisted pair cable, having a tighter twist than conventional twisted pair cable, this closer spacing means that the tighter twist can be maintained closer to the terminals thereby reducing discontinuities at the terminals.

By pairing terminals 50 intended to be used with wires in the same wire pair, extra space is left so terminals for different wire pairs, and the wire pairs themselves, can be spaced further apart in a connector of the same cross sectional area. As seen in FIG. 3 the two interior terminals 50 are spaced further apart than the paired terminals 50 on either the right or the left of the connector 10. In the preferred embodiment, the spacing between this second and third terminal 50 from the left, as shown in FIG. 3, is approximately 0.200 inch while the centerline spacing between paired terminals one and two or paired terminals three and four is approximately 0.100 inch. This greater centerline spacing between paired terminals and wires alone will reduce the crosstalk between adjacent pairs at the connector location by reducing capacitance between adjacent twisted wire pairs For higher transmission speeds and higher frequencies this capacitive crosstalk reduction is even more important. It has been demonstrated that by pairing inclined terminals on an 0.100 inch centerline for terminals associated with the same wire pair and by separating adjacent terminal pairs by 0.200 inch, a near end crosstalk (NEXT) reduction of approximately 6 db can be achieved at 100 MHz. Capacitance can be further reduced if the material separating terminals in different wire pairs has a lower dielectric constant. By coring out the central housing cavity 42, the plastic between the second and third terminals in different wire pairs is replaced by air and air has a lower effective dielectric constant than the plastics used to mold electrical connector housings. Angling the terminals and pairing the terminals in the manner shown leaves room for central cavity 42.

As shown in FIG. 3, the centerlines of adjacent terminals 50 are not constant in electrical connector 10. However the offset of the compliant pins 56 on the terminals allows the compliant pins to be kept on a constant centerline spacing. In the preferred embodiment the centerline spacing between adjacent compliant pins would be 0.150 inch while the spacing between the wire contact slots would be 0.100 between first and second terminals and between third and forth terminals, but would be 0.200 between the second and third terminals. By simply rotating the terminals 50 in the terminal cavities 36, the same terminals 50 can be used in all four terminal positions. In applications where it is not necessary to maintain the spacing of 0.150 inch used in conventional footprints, the compliant pin could be placed on the terminal centerline.

Figure 11:
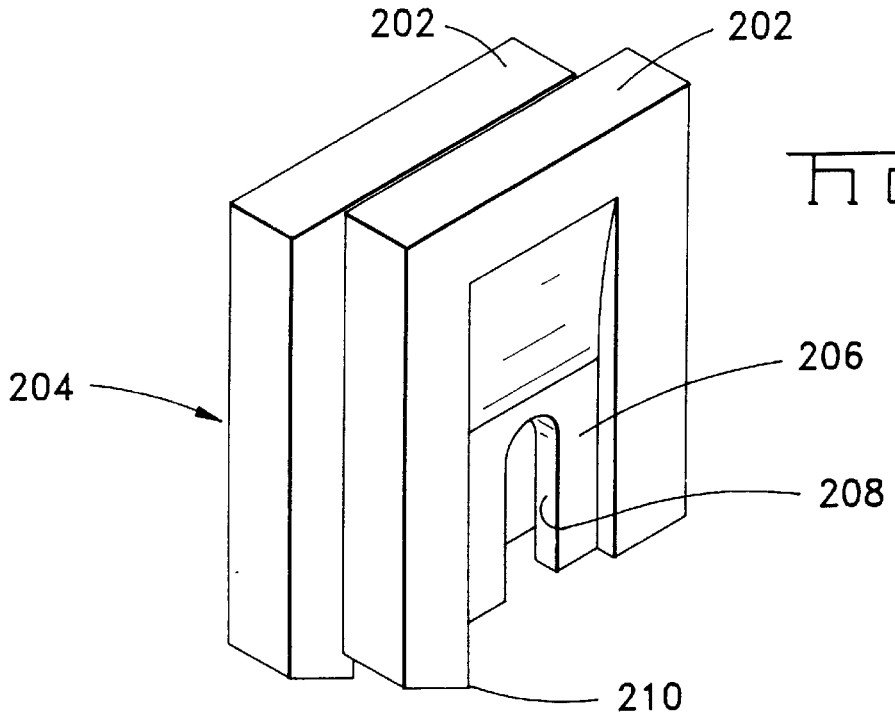
FIG. 11 is a perspective view of an insertion tool having two staggered insertion heads that could be used with an electrical connector of the type shown in FIGS. 2–4
Figure 12:
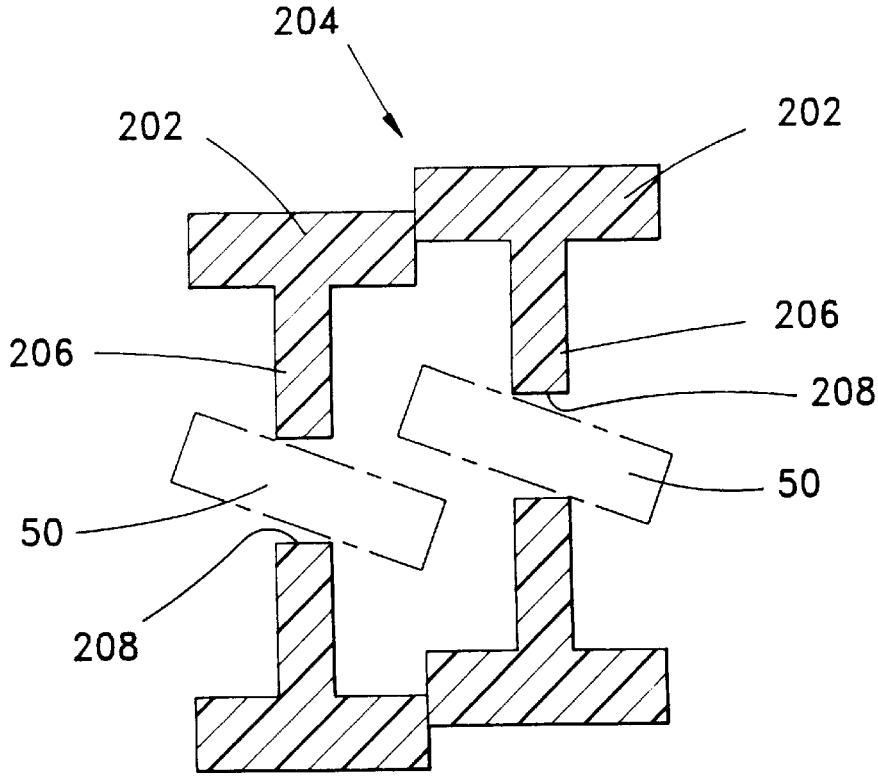
FIG. 12 is a section view of the staggered insertion tool shown in FIG. 11.

By angling and overlapping the paired terminals 50, the spacing between the wire contact slots and the sides of the housing 12 and the sides of the tapered divider walls 24 will not be constant. One slot will be in front of the other slot in two paired terminals. In other words, one slot will be closer to the front of the housing than the other This staggering of the wire contact slots gives rise to the offset or staggered configuration of the two tapered wall sections 26 and 28 as seen in FIGS. 2 and 3. Use of a standard single position tool 202 as shown in FIG. 2 means that the two tapered wall sections 26 and 28 must be offset since this single position tool is positioned by engagement with one half of each tapered wall section. When wires are inserted using this single position tool, it will be positioned relatively closer to the front of the connector for one wire and relatively closer to the rear of the connector for the next wire. FIGS. 11 and 12 show a new dual position tool 204 that consists of two staggered single position tools heads 202. The staggered configuration of the tapered divider walls 24 and the corresponding staggering of the central wall as shown in FIG. 3 will align the tool 204 so that each blade 206 and each wire insertion slot 208 will be aligned with the wire contact slot 54 in the corresponding terminal and the wire cutoff 209 will trim the end of the wire. The staggered dual tips permit termination both wires in a pair with a single stroke reducing the time needed by an operator to terminate the wires to the connector.

Although the inclined or angled configuration of the terminals 50 relative to the wire channels 34 permits terminals to be paired, this relative orientation of the terminals provides certain mechanical advantages that are not related to the improvement in coupling between wire pairs and the reduction in crosstalk. As discussed previously more force is required to insert a compliant pin, such as compliant pin 56 into a printed circuit board plated through hole than would be required to insert a solid pin that would be soldered to the plated through hole or to a trace on a single sided printed circuit board that did not employ plated through holes. Since multiple compliant pins are inserted at the same time, the force required to insert one compliant pin must be multiplied by the number of pins involved. With conventional electrical connectors, such as that shown in FIG. 1, insertion force must be applied directly to terminals 150 because retention force provided by the engagement between the plastic at 144 with the terminal opening left by tab 162 is not sufficient to withstand the force necessary to insert the compliant pins 156. Therefore insertion tooling must engage the tops of the terminals 156. The angled orientation of the terminals 50 in the connector 10 means that the terminals can be wider and sufficient space is then available for the shoulders 60 in terminals 50 or the shoulders 79 in terminals 70. These terminal shoulders now engage a relatively large housing shoulder 40 and the compliant pin insertion force can now be applied to the housing and transferred to the terminals. For the terminal 70, the amount of housing material that can be upset into the hole 78 is greater than that which can be upset into the opening left by tab 162 in the prior art configuration and even greater force can be applied through the housing to the terminal. For configurations in which a separate pin is inserted into opening 78, even greater force can be applied.

The angled configuration of the terminals 50 also provides additional space for increasing the thickness of the housing walls. This additional space is especially useful because the side walls 22 can be thicker in the preferred embodiment of this invention than for a conventional connector such as that shown in FIG. 1. Increasing the thickness of side walls 22 will reduce any tendency for these walls to break off due to excessive forces applied when the connector is in use. Staggering the terminals and positioning them on different centerlines, such as the 0.100 inch and 0.200 inch spacing used in the preferred embodiment also provides additional space for increasing the thickness of the housing walls.

The preferred embodiment of this invention is an electrical connector 10 that is used to connect twisted wire pairs to a printed circuit board. It should be understood inclined, paired terminals could be used in alternative connector configurations. For example, the inclined, paired terminals could be employed in a connector that would be used to splice two twisted wire pair cables. Such a connector would typically not be limited to a two pair cable. The invention is also not limited to use with a connector employing compliant pins. Solid pins that can be soldered to a printed circuit board could be employed. It should therefore be understood that although the preferred embodiment of this invention is directed to improvements in a prior art 110 style electrical connector, the invention, at least in its broadest aspects is not limited to the preferred embodiment of the invention depicted herein. For example, the inclined terminal configuration and the staggering could be used to achieve a similar improvement in electrical performance for a connector using a stamped and formed contact array employed in a connector including an insulation displacement input and a modular jack or other output connector. Therefore the invention is defined by the following claims and is not limited to the representative embodiments depicted herein.

We claim:

1. An electrical connector for use with first and second wire pairs, the connector comprising: a dielectric housing which holds first, second, third and fourth discrete terminals aligned in single row and adjacent to one another, each including a planar section having a wire contact slot, the housing having four wire channels which open into the housing and intersect respective ones of the wire contact slots, the wire channels extending parallel to each other in a longitudinal direction and the planar sections of the terminals being inclined with respect to the longitudinal direction, the planer section of the first terminal partially overlaps the planar section of the second terminal and the planar section of the third terminal partially overlaps the planer section of the fourth terminal, the first and second terminals comprising a first terminal pair for attachment to the first wire pair, a centerline of the first terminal being spaced from a centerline of the second terminal by a first distance, the third and fourth terminals comprising a second terminal pair for attachment to the second wire pair, a centerline of the third terminal being spaced from a centerline of the fourth terminal by a distance which is the same as the first distance, and the centerline of the second terminal being spaced from the centerline of the third terminal by a second distance which is greater than the first distance to reduce crosstalk between the first and the second terminal pairs and the first and second wire pairs.

2. The electrical connector of claim 1 wherein the housing includes a cavity between the second and third terminals, and the cavity holds a volume of air sufficient to lower a dielectric constant of the housing between the first and second terminal pairs, thereby reducing capacitance between the first and second terminal pairs and reducing the crosstalk between the first and second terminal pairs and the first and second wire pairs.

3. The electrical connector of claim 1 wherein the wire contact slots of the first and second terminals are longitudinally staggered, and the wire contact slots of the third and fourth terminals are longitudinally staggered.

4. The electrical connector of claim 1 wherein each said terminal includes a pin extending therefrom, and the pin is offset relative to the centerline of its corresponding said terminal.

5. The electrical connector of claim 4 wherein the pins of the first, second, third and fourth terminals are equally spaced apart.

6. An electrical connector comprising: an insulating housing and a plurality of discrete terminals, the housing including wire channels for receiving individual wires of twisted wire pairs, each said terminal including a planar slotted beam with a wire contact slot, the planar slotted beam extending into a corresponding wire channel with the wire contact slot centered within the corresponding wire channel for terminating said wire received in the wire channel, the terminals being inclined relative to the corresponding wire channels, the wire channels being arranged in first and second wire channel pairs associated with first and second wire pairs, a space between centerlines of each of said wire channel pairs is less than a space between centerlines of one wire channel in the first wire channel pair and an adjacent wire channel in the second wire channel pair, wherein each said terminal includes a pin extending from the housing, the pin is offset relative to a centerline of its corresponding said terminal, and the pins are equally spaced apart.

7. The electrical connector of claim 6 wherein the housing includes a cavity between the first wire channel pair and the second wire channel pair, and the cavity holds a volume of air sufficient to lower a dielectric constant of the housing between the first and second wire channel pairs and the wires positioned therein, thereby reducing capacitance and crosstalk between the first wire pair and the second wire pair.

8. The electrical connector of claim 6 wherein the terminals are associated in first and second terminal pairs corresponding to the first and second wire pairs, and the wire contact slots of the terminals in each said terminal pair are staggered relative to a plane that is equidistant between front and rear faces of the housing.

9. An electrical connector comprising:

a dielectric housing which holds first, second, third and fourth discrete terminals aligned in a single row and adjacent to one another, each including a planar section having a wire contact slot, the housing having four wire channels which open into the housing and intersect respective ones of the wire contact slots, the wire channels extending parallel to each other in a longitudinal direction and the planar sections of the terminals being inclined with respect to the longitudinal direction, a centerline of the first terminal being spaced from a centerline of the second terminal by a first distance, a centerline of the third terminal being spaced from a centerline of the fourth terminal by a distance which is the same as the first distance, and the centerline of the second terminal being spaced from the centerline of the third terminal by a second distance which is greater than the first distance, wherein each said terminal includes a pin extending therefrom, the pin is offset relative to the centerline of its corresponding said terminal, and the pins of the first, second, third and fourth terminals are equally spaced apart.

10. The electrical connector of claim 9 wherein the planar section of the first terminal partially overlaps the planar section of the second terminal and the planar section of the third terminal partially overlaps the planar section of the fourth terminal.

11. The electrical connector of claim 10 wherein the wire contact slots of the first and second terminals are longitudinally staggered, and the wire contact slots of the third and fourth terminals are longitudinally staggered.

12. An electrical connector comprising:

an insulating housing and a plurality of discrete terminals, the housing including wire channels for receiving individual wires of twisted wire pairs, each said terminal including a planar slotted beam with a wire contact slot, the planar slotted beam extending into a corresponding wire channel with the wire contact slot centered within the corresponding wire channel for terminating said wire received in the wire channel, the terminals being inclined relative to the corresponding wire channels, the wire channels being arranged in first and second wire channel pairs associated with first and second wire pairs, and a space between centerlines of each of said wire channel pairs is less than a space between centerlines of one wire channel in the first wire channel pair and an adjacent wire channel in the second wire channel pair wherein each said terminal includes a pin extending from the housing, the pin is offset relative to a centerline of its corresponding said terminal, and the pins are equally spaced apart.

13. The electrical connector of claim 12 wherein the housing includes a cavity between the first wire channel pair and the second wire channel pair, and the cavity holds a volume of air sufficient to lower a dielectric constant of the housing between the first and second wire channel pairs and the wires positioned therein, thereby reducing capacitance and crosstalk between the first wire pair and the second wire pair.

14. The electrical connector of claim 12 wherein the terminals are associated in first and second terminal pairs corresponding to the first and second wire pairs, and the wire contact slots of the terminals in each said terminal pair are staggered relative to a plane that is equidistant between front and rear faces of the housing.

15. An electrical connector for use with first and second wire pairs, the connector comprising:

a dielectric housing which holds first, second, third and fourth discrete terminals aligned in a single row and adjacent to one another, each including a planar section having a wire contact slot, the housing having four wire channels which open into the housing and intersect respective ones of the wire contact slots, the first and second terminals comprising a first terminal pair for attachment to the first wire pair, the third and fourth terminals comprising a second terminal pair for attachment to the second wire pair, wherein the housing includes a cavity between the second and third terminals, and the cavity holds a volume of air sufficient to lower a dielectric constant of the housing between the first and second terminals pairs, thereby reducing capacitandce between the first and second terminal pairs and reducing crosstalk between the first and second terminal pairs and between the first and second wire pairs.

* * * * *